US006151714A

United States Patent [19]

Pratt

[11] Patent Number: 6,151,714

[45] Date of Patent: Nov. 28, 2000

[54] PROTECTIVE ATHLETIC PADS FOR JOINT SURFACES

[75] Inventor: Michael K. Pratt, Worcester, Mass.

[73] Assignee: Seneca Sports, Inc., Milford, Mass.

[21] Appl. No.: 09/395,818

[22] Filed: Sep. 14, 1999

[51] Int. Cl.[7] ..... A41D 13/00

[52] U.S. Cl. ..... 2/24; 2/455; 602/26

[58] Field of Search ..... 2/24, 22, 23, 16, 2/455, 267, 911; 128/878, 881, 882; 602/25, 26, 62

[56] References Cited

U.S. PATENT DOCUMENTS

| | | | |
|---|---|---|---|
| D. 298,669 | 11/1988 | Kushitani . | |
| 1,271,119 | 7/1918 | Barrett . | |
| 1,434,808 | 11/1922 | Burnett et al. . | |
| 1,637,116 | 7/1927 | Kelley . | |
| 2,093,888 | 9/1937 | Holtje . | |
| 2,338,424 | 1/1944 | Giardini | 2/22 |
| 4,142,252 | 3/1979 | Storer . | |
| 4,193,134 | 3/1980 | Hanrahan . | |
| 4,252,910 | 2/1981 | Schaefer . | |
| 4,354,280 | 10/1982 | Hayes . | |
| 4,599,747 | 7/1986 | Robinson . | |
| 4,730,610 | 3/1988 | Graebe . | |
| 4,879,765 | 11/1989 | Bailie et al. . | |
| 4,888,826 | 12/1989 | Parsons et al. | 2/22 |
| 4,905,320 | 3/1990 | Squyers | 2/22 |
| 5,168,576 | 12/1992 | Krent et al. . | |
| 5,255,391 | 10/1993 | Levine | 2/24 |
| 5,450,625 | 9/1995 | Hu . | |
| 5,480,397 | 1/1996 | Eggers et al. . | |
| 5,496,610 | 3/1996 | Landi et al. . | |
| 5,500,955 | 3/1996 | Gongea . | |
| 5,594,954 | 1/1997 | Hunag | 2/24 |
| 5,634,211 | 6/1997 | Chen . | |
| 5,753,332 | 5/1998 | Hsu . | |
| 5,781,935 | 7/1998 | Bassett et al. . | |
| 5,840,397 | 11/1998 | Landi et al. . | |
| 5,915,529 | 6/1999 | Popowski | 2/16 |
| 5,943,695 | 3/2000 | Yen | 2/22 |
| 6,032,300 | 3/2000 | Bainbridge et al. | 2/456 |

*Primary Examiner*—John J. Calvert
*Assistant Examiner*—Tejash Patel
*Attorney, Agent, or Firm*—Fish & Richardson P.C.

[57] ABSTRACT

A protective pad for a joint surface of a wearer's limb during athletic activity such as skating and skateboarding has a cushioning element and a shielding element mounted thereto. The cushioning element has a body with a first surface to overlie the joint surface and an opposite second surface. The shielding element has a primary wall forming a domed central region surrounded by a peripheral flange engaged upon the second surface of the cushioning body. In the central region, the primary wall defines an outer, obstruction-engaging surface and an inner wall surface. The shielding element also has a plurality of interengaged support wall segments extending from the inner wall surface toward, but spaced from engagement with, the second surface of the cushioning body. The shielding and cushioning elements, in a central region of the cushioning body bounded by the peripheral flange and overlying the joint surface, together define, at rest, a cavity between the support wall segments and the second surface of the cushioning body. The shielding element is relatively more resistant to flexing than the cushioning element, and upon application of a force to the obstruction-engaging surface of the protective pad overlying the joint surface to be protected, the shielding element resists flexing as the cushioning element flexes to permit penetration of the joint surface into the cavity, thus to absorb force and protect the joint surface.

14 Claims, 4 Drawing Sheets

PROTECTIVE ATHLETIC PADS FOR JOINT SURFACES

The invention relates to pads for protection of joint surfaces, e.g. of the knee or elbow, during sports activities such as skating and skateboarding.

BACKGROUND OF THE INVENTION

Protective pads for joint surfaces, e.g., of the knee or elbow, to be worn during sports activities such as skating and skateboarding, are widely available.

Many forms of protective padding are constructed as composite assemblies in which a shock absorbing layer is positioned within an outer shell and/or attached to a rigid plate. Examples include: Landi et al. U.S. Pat. Nos. 5,496,610 and 5,840,397 and Hu U.S. Pat. No. 5,450,625, all of which describe composite pad assemblies having a shock absorbing layer in the form of a honeycomb.

Other protective pads have been integrally formed by molding, e.g., as described in Kushitani U.S. Design Pat. No. 298,669, in Hayes U.S. Pat. No. 4,354,280, and in Holtje U.S. Pat. No. 2,093,388.

SUMMARY OF THE INVENTION

According to the invention, a protective pad for a joint surface of a wearer's limb during athletic activity such as skating and skateboarding comprises a cushioning element and a shielding element. The cushioning element comprises a cushioning body having a first surface to overlie the joint surface to be protected and an opposite second surface. The shielding element comprises a primary wall forming a domed central region surrounded by a peripheral flange, the peripheral flange being engaged upon the opposite second surface of the cushioning body, and the primary wall, in the central region, defining an outer, obstruction-engaging surface and an inner surface. The shielding element further comprises a plurality of interengaged support wall segments extending from the inner wall surface toward, but spaced from engagement with, the opposite second surface of the cushioning body. The shielding and cushioning elements, in a central region of the cushioning body bounded by the peripheral flange and overlying the joint surface to be protected, together define, at rest, a cavity between the interengaged support wall segments and the opposite second surface of the cushioning body. The shielding element is relatively more resistant to flexing than the cushioning element, so that, upon application of a force to the obstruction-engaging surface of the protective pad overlying the joint surface of a wearer's limb to be protected, the shielding element resists flexing as the cushioning member flexes to permit penetration of the joint surface into the cavity, thus absorbing the force and protecting the joint surface.

Preferred embodiments of the invention may include one or more of the following additional features. The cushioning element is generally planar. The shielding element, comprising the primary wall, peripheral flange and interengaged support wall segments, is formed as an integral unit, preferably by molding. Preferably, the interengaged support wall segments of the shielding element are arranged in a honeycomb. The shielding element, or at least the primary wall of the shielding element, is transparent. The protective pad comprises at least one fastener for attaching the protective pad upon the limb to overlie the joint surface to be protected. The fastener comprises straps sized to extend about the limb at both sides of the joint surfaces. The straps have at least one free end releasably fastened to the cushioning element, e.g., by cooperating hook-and-loop type fasteners. The straps are elastic. The peripheral flange of the shielding element is attached upon the opposite second surface of the cushioning body by stitching.

Other features and advantages of the invention will be apparent from the following description of a presently preferred embodiment, and from the claims.

DESCRIPTION OF THE PREFERRED EMBODIMENTS

Figure 1:
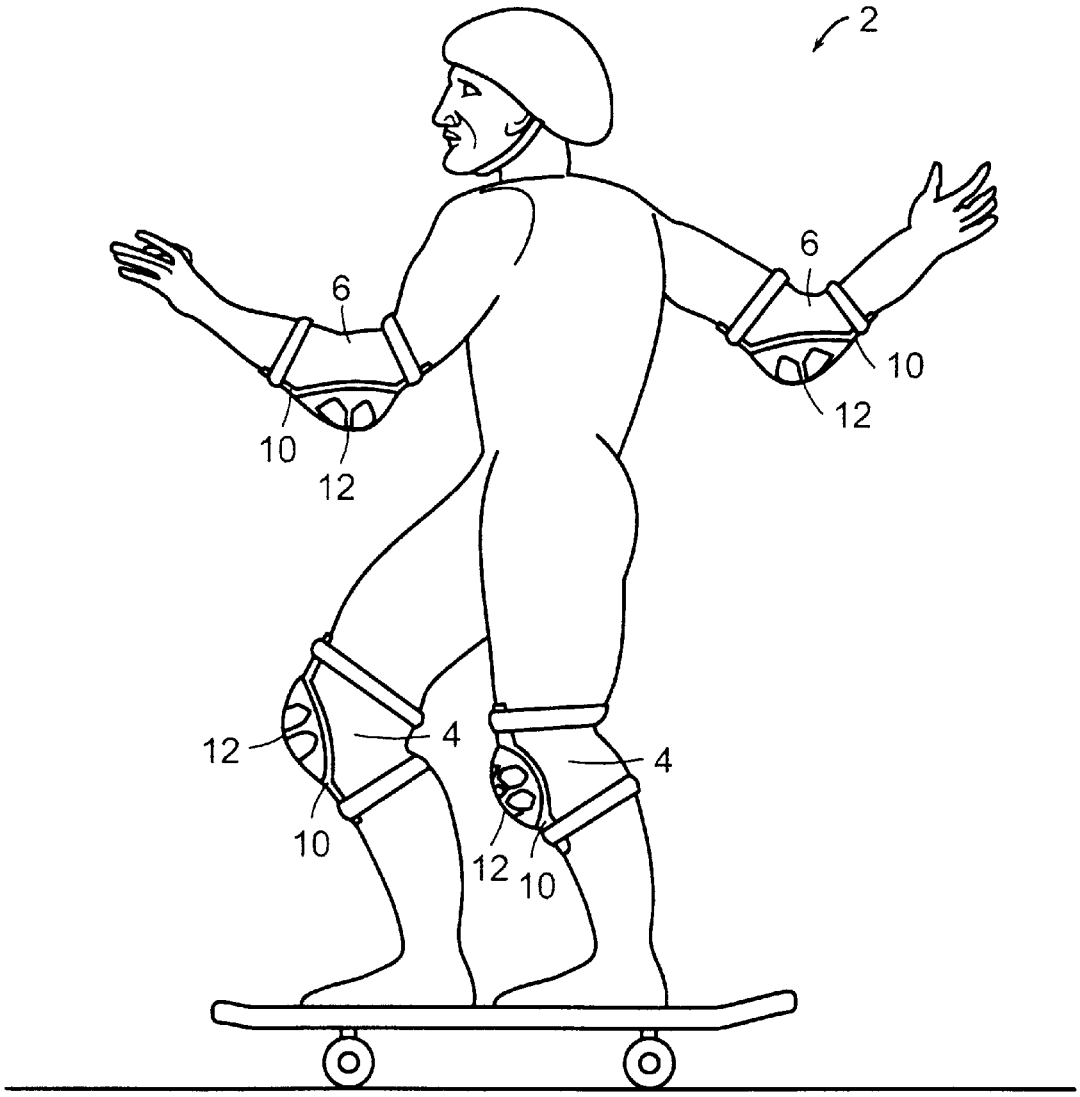
FIG. 1 is a somewhat diagrammatic view of a person engaged in an athletic activity, here, a skateboarder, wearing knee and elbow protective pads of the invention.

As illustrated in FIG. 1, protective pads 10 of the invention are worn to protect the joint surfaces of the limbs (e.g., knees 4 and elbows 6) of a person 2 engaged in a sports activity such as skateboarding (as shown), skating, and the like. The protective pad 10 is positioned and secured upon the wearer's limb to overlie the surface of the joint 4, 6 to be protected, as will be described more fully below. The protective pad 10 includes a shielding element 12 and a cushioning element 14.

Figure 2:
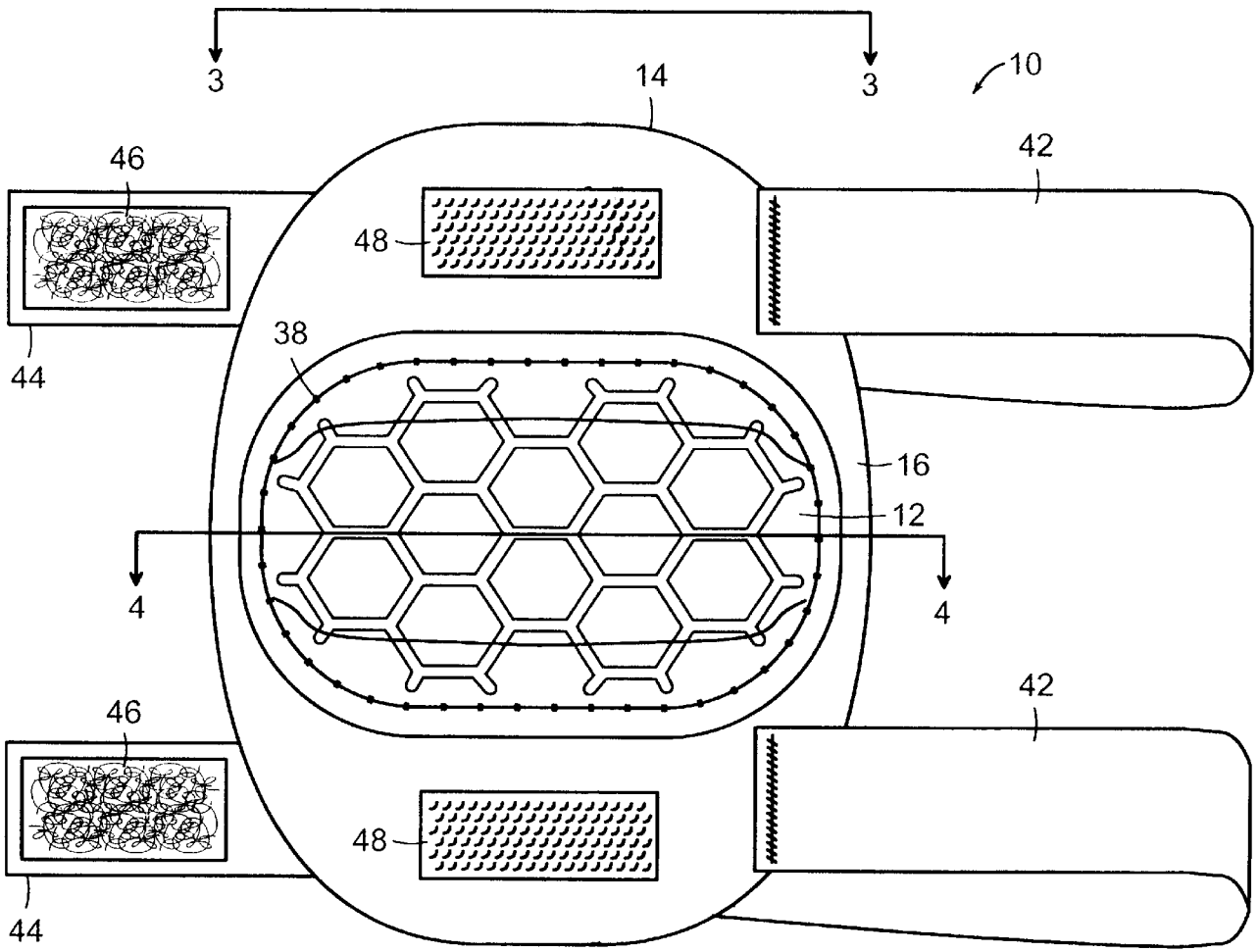
FIG. 2 is a top view of a protective pad of the invention, with the fastener straps in open condition.
Figure 3:
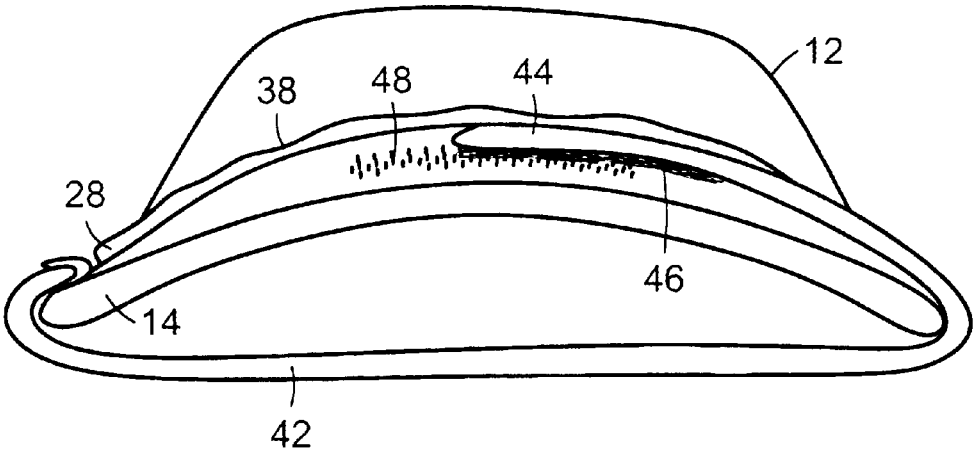
FIG. 3 is a side view of the protective pad of the invention, taken at line 3—3 of FIG. 2, with the fastener straps in closed condition.
Figure 4:
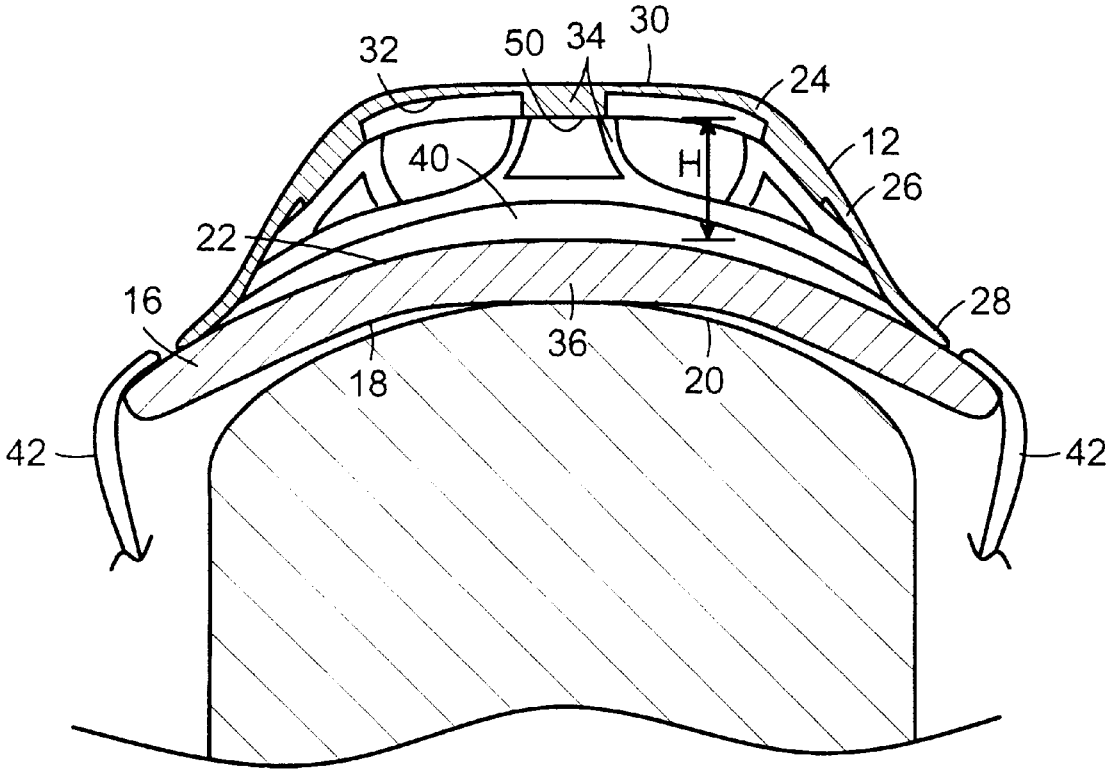
FIG. 4 is a section view of the protective pad of the invention, taken at line 4—4 of FIG. 2, with the joint to be protected partially shown, the protective pad in a non-impact condition.

Referring also to FIGS. 2–4, the cushioning element 14 has a generally planar cushioning body 16 with a first surface 18 for overlying the joint surface 20 to be protected and an opposite second surface 22. The cushioning body is formed, e.g., of fabric and flexible, resilient cushioning material such as expanded polymeric foam.

The shielding element 12 has a primary wall 24 forming a domed central region 26 surrounded by a peripheral flange 28. The peripheral flange is engaged and secured, e.g. by stitching 38, upon the opposite second surface 22 of cushioning body 16. The primary wall 24, in the central region 26, defines an outer, generally smooth, obstruction-engaging surface 30 and an inner wall surface 32. The shielding element 12 further has a plurality of interengaged support wall segments 34 extending from the inner wall surface 32 toward, but with the lower edges 50 spaced from engagement with, the opposite second surface 22 of the cushioning body 16. The interengaged support wall segments 34 are preferably arranged in a honeycomb pattern, as shown. The shielding element 12, consisting of the primary wall 24, the peripheral flange 28, and the interengaged support wall segments 34, is formed as an integral unit, preferably by molding of a suitable, semi-soft, resilient, transparent, synthetic resin material.

The protective pad 10 is positioned to overlie the joint surface 20 to be protected by a pair of elastic straps 42 extending about the limb. Preferably, the straps have free ends 44 releasably secured to the first surface 18 of the cushioning body 16 by cooperating elements 46, 48 of hook-and-loop type fasteners. The straps 42 allow the wearer to conveniently position and secure the protective pad 10 to overlie the joint surface 20 to be protected.

Figure 5:
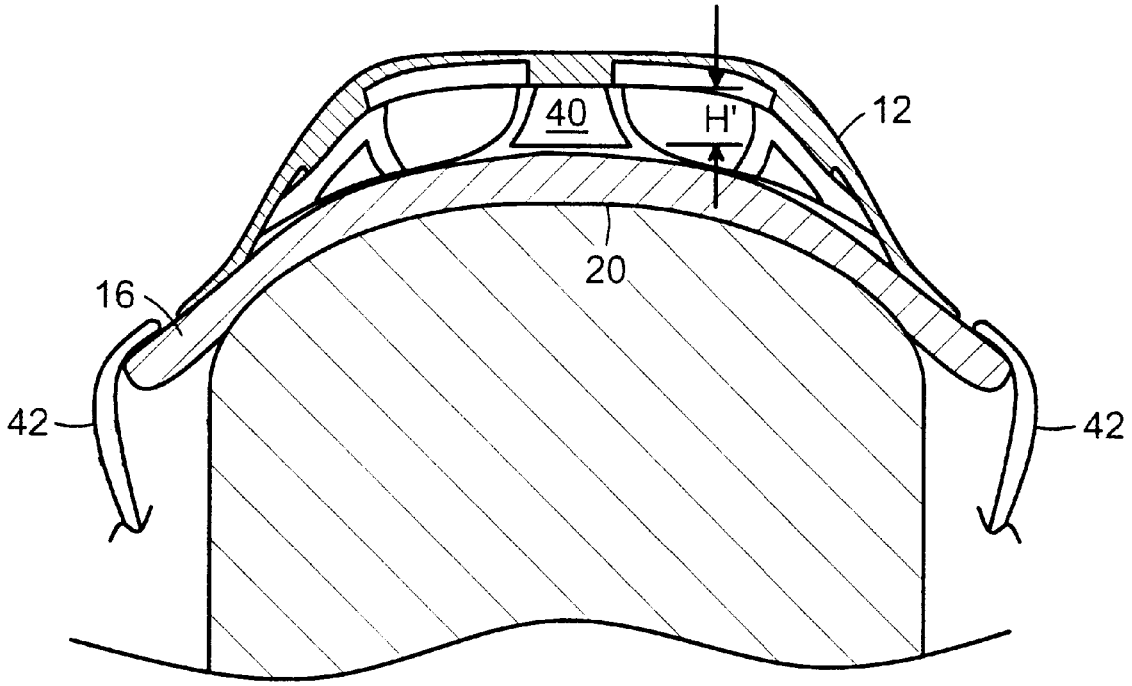
FIG. 5 is the section view of FIG. 4 with the protective pad in an impact condition.

The shielding element 12 and the cushioning element 14, in a central region 36 of the cushioning body 16 bounded by the peripheral flange 28 and overlying the joint surface 20 to be protected, together define, at rest, a cavity 40 of height H (FIG. 4) between the interengaged support wall segments 34 and the opposite second surface 22 of cushioning body 16. The shielding element 12 is relatively more resistant to flexing than the cushioning element 16, whereby, upon application of a force to the obstruction-engaging surface 30 of the protective pad 10 overlying the joint surface 20 of a wearer's limb to be protected, the shielding element 12 resists flexing as the cushioning element 14 flexes to permit penetration of the joint surface 20 into the cavity 40, reducing the height of cavity 40, e.g., to H' (as shown in FIG. 5), thus to absorb force and protect the joint surface 20, e.g., against injury.

Use of transparent synthetic resin to form the shielding element 12 allows the internal honeycomb structural walls 26 to be visible through the primary wall 24. This permits the wearer to make a visual inspection (e.g., damage assessment) of the internal dome structure.

Other embodiments are within the following claims.

What is claimed is:

1. A protective pad for a joint surface of a wearer's limb during athletic activity such as skating and skateboarding, said protective pad comprising:

a cushioning element comprising a cushioning body having a first surface for overlying the joint surface to be protected and an opposite second surface, and a shielding element comprising a primary wall forming a domed central region surrounded by a peripheral flange, said peripheral flange engaged upon said opposite second surface of said cushioning body, and said primary wall, in said central region, defining an outer, obstruction-engaging surface and an inner wall surface, said shielding element further comprising a plurality of interengaged support wall segments extending from said inner wall surface toward, but spaced from engagement with, said opposite second surface of said cushioning body, said shielding element and said cushioning element, in a central region of said cushioning body bounded by said peripheral flange and overlying the joint surface to be protected, together defining, at rest, a cavity between said interengaged support wall segments and said opposite second surface of said cushioning body, and said shielding element being relatively more resistant to flexing than said cushioning element, whereby, upon application of a force to said obstruction-engaging surface of said protective pad overlying the joint surface of a wearer's limb to be protected, said shielding element resists flexing as said cushioning element flexes to permit penetration of the joint surface into said cavity, thus to absorb the force and protect the joint surface.

2. The protective pad for a joint surface of claim 1, wherein said cushioning element is generally planar.

3. The protective pad for a joint surface of claim 1, wherein said shielding element comprising said primary wall, said peripheral flange, and said interengaged support wall segments, is formed as an integral unit.

4. The protective pad for a joint surface of claim 3, wherein said shielding element formed as an integral unit is formed by molding.

5. The protective pad for a joint surface of claim 3 or 4, wherein said interengaged support wall segments of said shielding element are arranged in a honeycomb.

6. The protective pad for a joint surface of claim 1, wherein said interengaged support wall segments of said shielding element are arranged in a honeycomb.

7. The protective pad for a joint surface of claim 1, 3, 4 or 6, wherein at least said primary wall of said shielding element is transparent.

8. The protective pad for a joint surface of claim 7, wherein said shielding element is transparent.

9. The protective pad for a joint surface of claim 1, further comprising at least one fastener for attaching said protective pad upon the limb to overlie the joint surface to be protected.

10. The protective pad for a joint surface of claim 9, wherein said at least one fastener comprises straps sized to extend about the limb at both sides of the joint surface.

11. The protective pad for a joint surface of claim 10, wherein said straps have at least one free end releasably fastenable to said cushioning element.

12. The protective pad for a joint surface of claim 11, wherein said straps have at least one free end releasably fastened to said cushioning element by cooperating hook-and-loop type fasteners.

13. The protective pad for a joint surface of claim 10, 11 or 12, wherein said straps are elastic.

14. The protective pad for a joint surface of claim 1, wherein said peripheral flange of said shielding element is attached upon said opposite second surface of said cushioning body by stitching.

* * * * *